US005791049A

United States Patent [19]

Dolev

[11] Patent Number: 5,791,049

[45] Date of Patent: Aug. 11, 1998

[54] NAIL CUTTER

[76] Inventor: Moshe Dolev, 4 Hamlacha Street, Raanana, Israel, 43100

[21] Appl. No.: 850,282

[22] Filed: May 5, 1997

[51] Int. Cl.[6] ..... A45D 29/02

[52] U.S. Cl. ..... 30/28; 132/75.5

[58] Field of Search ..... 30/26–28; 132/73.6, 132/75.5, 75.8

[56] References Cited

U.S. PATENT DOCUMENTS

| | | | |
|---|---|---|---|
| 775,568 | 11/1904 | LaMay | 30/28 |
| 2,532,370 | 12/1950 | Perrill . | |
| 2,544,248 | 3/1951 | Ashmead . | |
| 3,596,667 | 8/1971 | Buercklin . | |
| 4,117,854 | 10/1978 | Rosenbloom . | |
| 4,328,819 | 5/1982 | Haas . | |
| 4,753,253 | 6/1988 | Hutson . | |
| 4,854,334 | 8/1989 | Su . | |
| 4,896,684 | 1/1990 | Chou . | |
| 5,123,430 | 6/1992 | Davidovitz . | |

FOREIGN PATENT DOCUMENTS

| | | |
|---|---|---|
| 1 457 446 | 1/1969 | Germany . |
| 1 457 442 | 3/1969 | Germany . |
| 27 52 179 | 6/1979 | Germany . |
| 8005818 | 5/1982 | Netherlands . |
| 2 191 396 | 12/1987 | United Kingdom . |

*Primary Examiner*—Douglas D. Watts
*Attorney, Agent, or Firm*—Darby & Darby

[57] ABSTRACT

A nail cutter including a cutting plate defining a non-sharpened cutting surface, a cutting blade and a driver for bringing the cutting blade and the cutting surface into cutting engagement with a nail disposed between the cutting blade and the cutting surface.

18 Claims, 6 Drawing Sheets

NAIL CUTTER

FIELD OF THE INVENTION

The present invention relates to personal care devices generally and more particularly to nail cutters.

BACKGROUND OF THE INVENTION

Various types of nail cutters are known in the art. The following patents are believed to be representative of the state of the art: U.S. Pat. Nos. 5,123,430; 4,896,684; 4,854,334; 4,753,253; 4,328,819; 4,117,854; 3,596,667; 2,532,370 and 2,544,248; German Patent Documents 2,752,179; 1,457,446; 1,457,442; Netherlands Patent Document 8005818 and British Patent 2,1919,396.

SUMMARY OF THE INVENTION

The present invention seeks to provide an improved nail cutter.

There is thus provided in accordance with a preferred embodiment of the invention a nail cutter including a cutting plate defining a non-sharpened cutting surface, a cutting blade and a driver for bringing the cutting blade and the cutting surface into cutting engagement with a nail disposed between the cutting blade and the cutting surface.

In accordance with a preferred embodiment of the present invention, the edge of the cutting blade is curved in three dimensions so as to be adapted to the curvature of a user's nail to be cut.

Additionally in accordance with a preferred embodiment of the invention the cutting plate has a forward surface which is adjustable relative to the cutting blade for determining the depth of the cut.

Further in accordance with a preferred embodiment of the present invention the width of the cutting blade is greater than that of most nails to be cut and the cutting blade is formed with curves at both edges thereof, such that a nail can be sequentially brought into cutting position adjacent both edges of the cutting blade for complete cutting of the nail.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1:
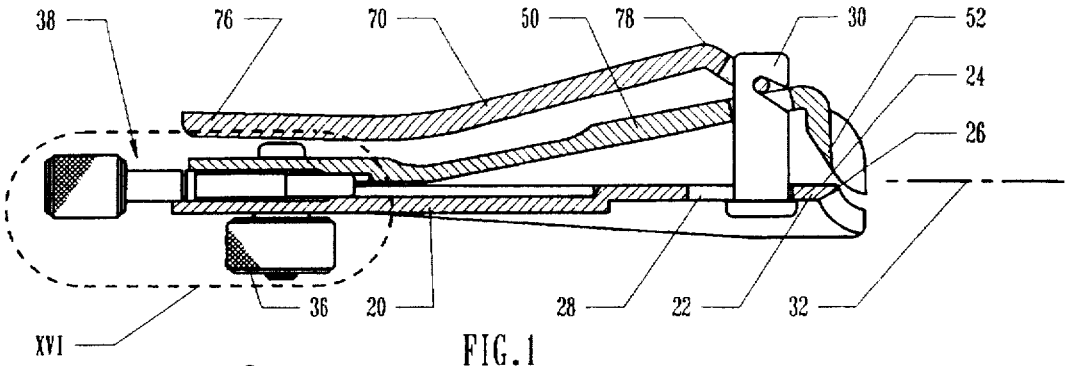
FIG. 1 is a side sectional illustration of a nail cutter constructed and operative in accordance with a preferred embodiment of the present invention in a folded and locked orientation.

Reference is now made to FIGS. 1–9 and 16–18, which illustrate a manually operated nail cutter constructed and operative in accordance with a preferred embodiment of the present invention. The nail cutter preferably comprises a base element 20, typically stamped of soft stainless steel.

The base element 20 preferably comprises a generally planar elongate element which defines a cutting plate 22 at a forward portion thereof, having an upper facing cutting surface 24. The cutting plate 22 has a forward facing edge surface 26 which is intended to engage the forward facing surface of a finger under a nail to be cut.

Rearward of cutting plate 22, base element 20 defines an elongate slot 28 which accommodates a pin 30 and permits selectable positioning of the cutting plate 22 relative to the pin 30 about a longitudinal axis 32. Towards the rear of base element 20 there is provided an additional elongate slot 34 which accommodates a tightening screw assembly 36, and a positioning screw assembly 38 which cooperate to enable user adjustment of the closeness of the cut, as will be described hereinbelow.

Operatively associated with the base element 20 and selectably positioned relative thereto by means of screw assemblies 36 and 38 is a cutting element 50, which is typically stamped from hardened alloy steel in a generally planar elongate configuration. Preferably the forward end of the cutting element is bend downward and sharpened to define a cutting blade 52.

Rearwardly of cutting blade 52 there is provided an aperture 54 which accommodates pin 30. At the rear end of cutting element 50 there is provided a further aperture 59 which accommodates tightening screw assembly 36.

It is a particular feature of the present invention that the cutting blade 52 is positioned to operatively engage a generally non-sharpened cutting plate surface 24, in contrast to the prior art wherein a pair of cutting blades are provided for blade-to-blade facing engagement.

It is a further particular feature of the present invention that the cutting blade 52, and preferably also the cutting plate surface 24 and its forward edge 26, is curved in three dimensions so as to be adapted to the curvature of a user's nail to be cut. This curvature is shown particularly in FIGS. 4 and 5.

It is appreciated that by curving both the cutting blade 52 and forward edge 26 in three dimensions so as to be adapted to the general shape of a user's nail, the maximum spacing between the cutting blade and the cutting plate surface may be kept quite small, thus reducing the chance that a body part not intended to be cut might be inadvertently inserted between the blade and the cutting plate and be cut.

It is an additional particular feature of the present invention that the position of the forward edge surface 26 is adjustable relative to the cutting blade 52 for determining the depth of the cut. This adjustment is achieved in the illustrated embodiment by decoupling the cutting element 50 from the base element 20 by loosening screw assembly 36 and then suitably manipulating screw assembly 38 to achieve a desired depth of cut.

It is noted that in all cases, the forward edge surface 26 extends forwardly of the cutting blade, thus spacing the user's finger from the cutting blade and preventing inadvertent cutting of the non-nail portion of the finger.

Figure 16:
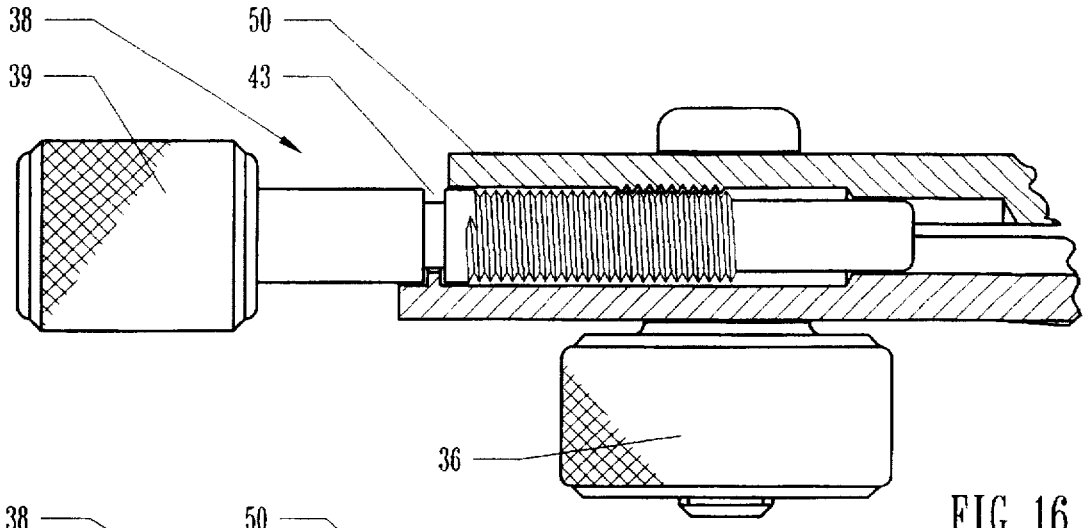
FIGS. 16, 17 and 18 are enlarged partially cut away sectional illustrations of portions of FIGS. 1, 2 and 3 indicated on FIGS. 1, 2, and 3 by broken lines labeled respectively XVI, XVII and XVIII.
Figure 17:
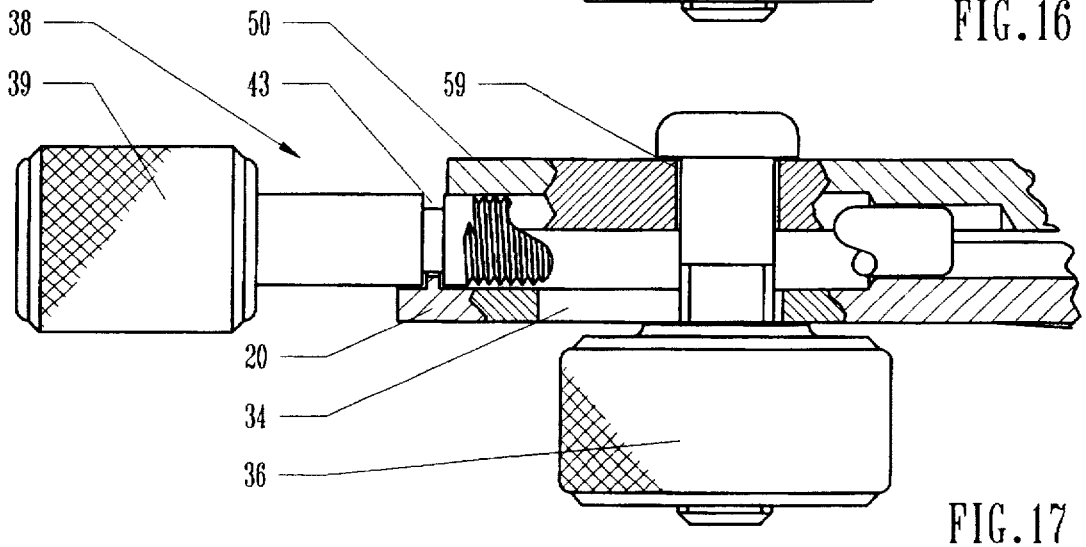
Figure 18:
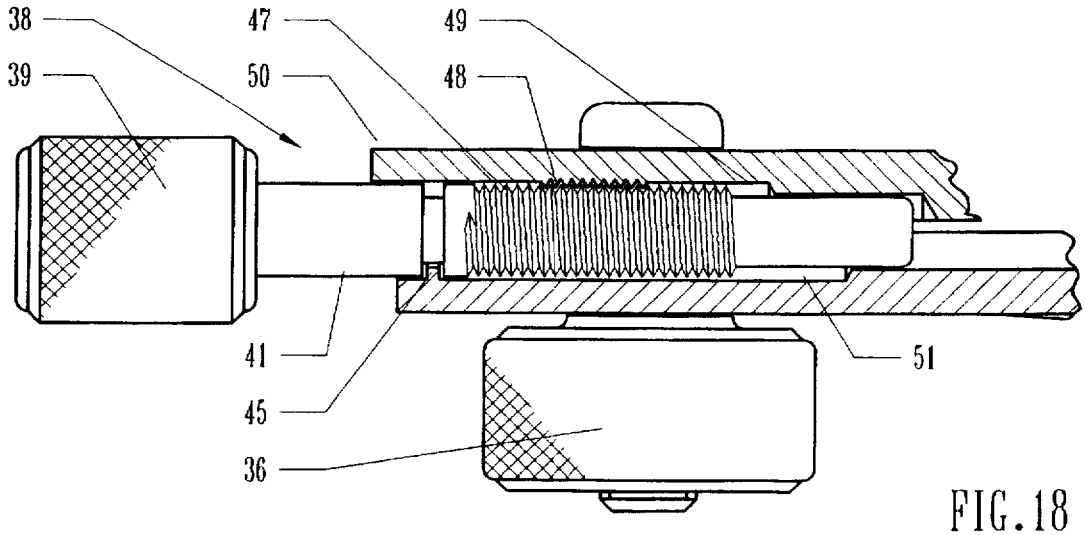

Reference is now made particularly to FIGS. 16–18, which illustrate the operation of tightening screw assembly 36 and positioning screw assembly 38 which cooperate to enable user adjustment of the closeness of the cut. Positioning screw assembly 38 preferably comprises a knob 39 which is integrally formed with or fixedly attached to a shaft 41 having a cylindrical notch 43 formed therein. Notch 43 is engaged by a protrusion 45 integrally formed with base element 20.

Shaft 41 is formed with a threaded portion 47 which is threadably engaged by a correspondingly threaded portion 48 of a generally half-circular cylindrical recess 49 formed in a cutting element 50. A corresponding half-circular cylindrical recess 51, generally facing recess 49, is formed on base element 20.

When tightening screw assembly 36 is sufficiently loosened so as to permit relative movement between the base element 20 and the cutting element 50, rotation of knob 39 and consequent rotation of the threaded portion 47 of shaft 41 causes translation of the cutting element 50 relative to the base element 20 along axis 32 (FIG. 1). Thus, it can be seen that in the orientation of FIGS. 2 and 17, edge 26 of the cutting plate is extended only a relatively short distance X beyond the cutting blade, while in the orientation of FIGS. 3 and 18, edge 26 of the cutting plate is extended a relatively large distance Y beyond the cutting plate.

Figure 2:
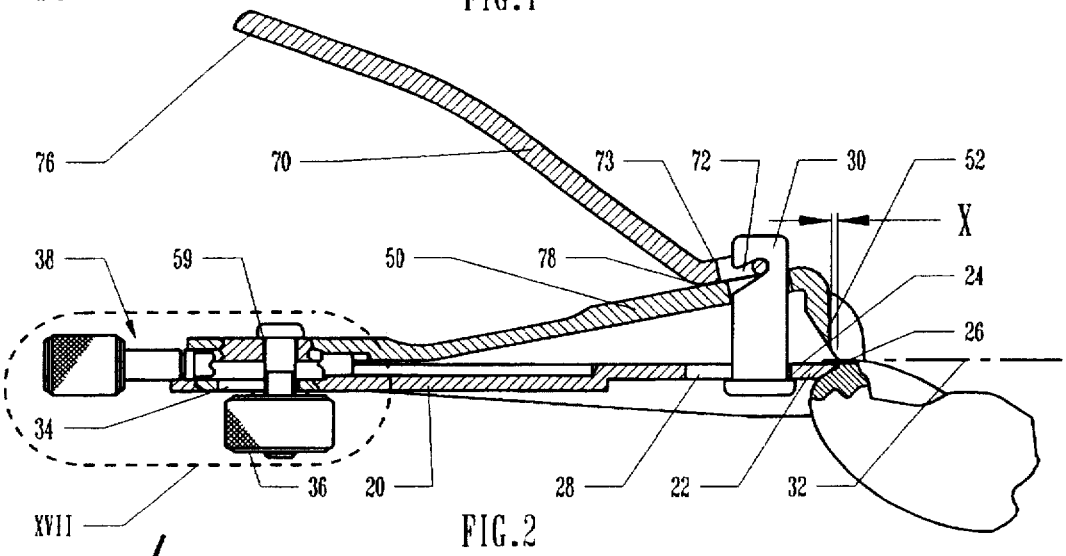
FIG. 2 is a side sectional illustration of the nail cutter of FIG. 1 in close-cut operative engagement with a nail about to be cut.
Figure 3:
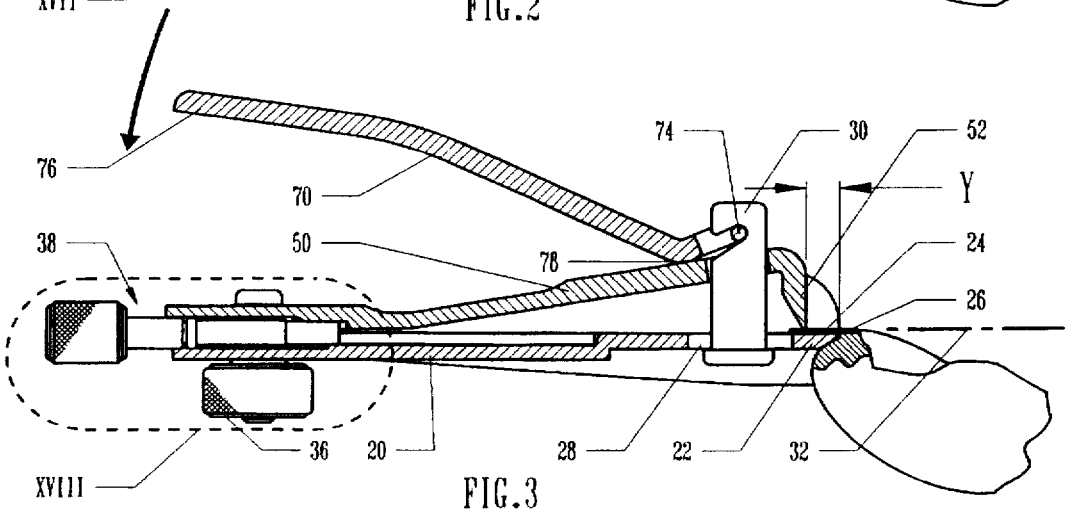
FIG. 3 is a side sectional illustration of the nail cutter of FIG. 1 in long-cut cutting engagement with a nail.
Figure 4:
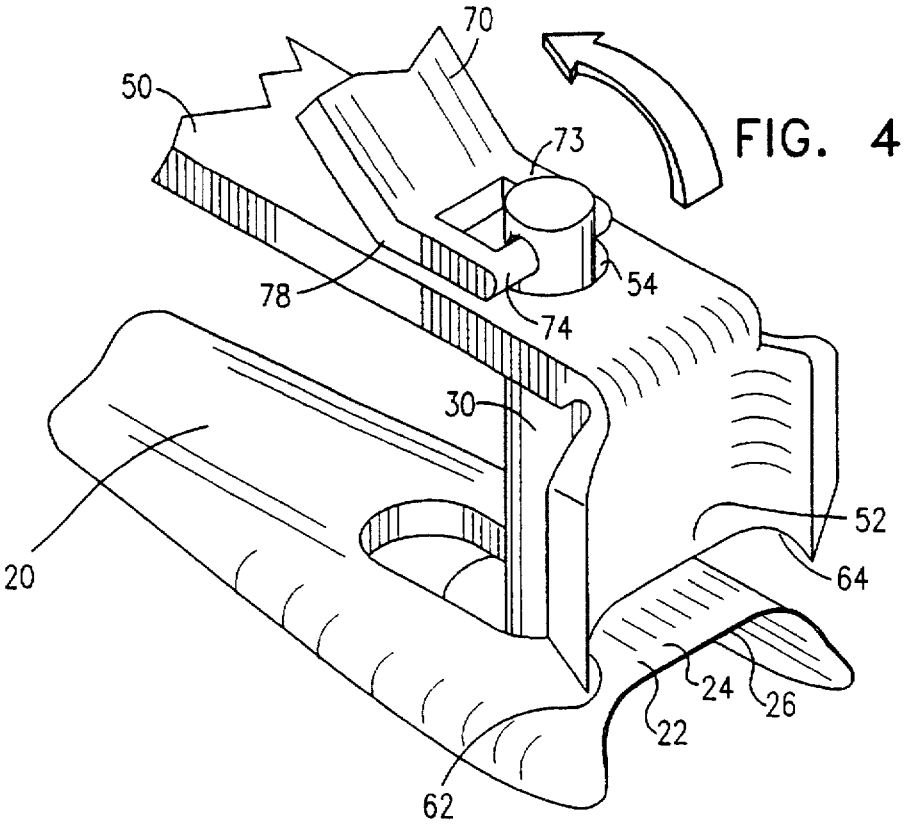
FIGS. 4 and 5 are pictorial illustrations of the nail cutter of FIGS. 2 and 3 in respective pre-cutting and cutting operative orientations.
Figure 5:
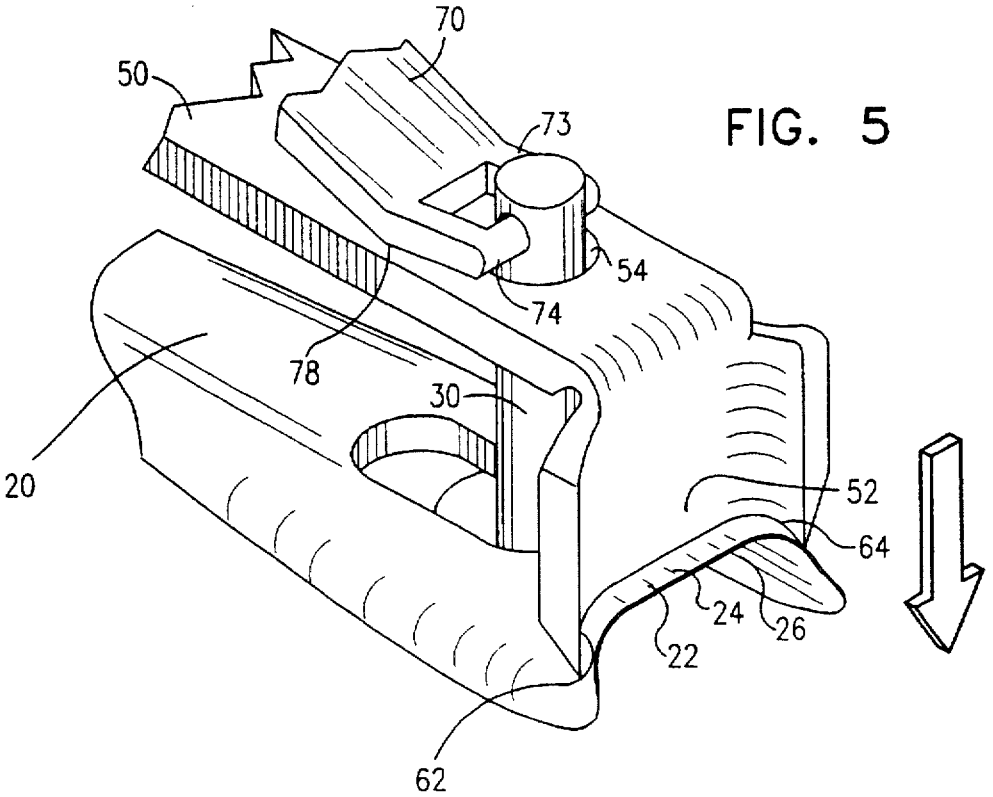
Figure 6:
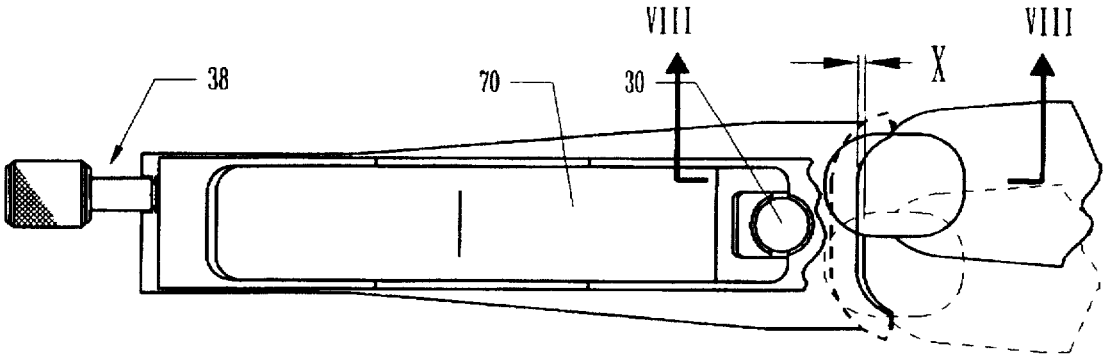
FIGS. 6 and 7 are top view illustrations of the nail cutter of FIGS. 1–5 adjusted for respective close-cut and long-cut operation.
Figure 7:
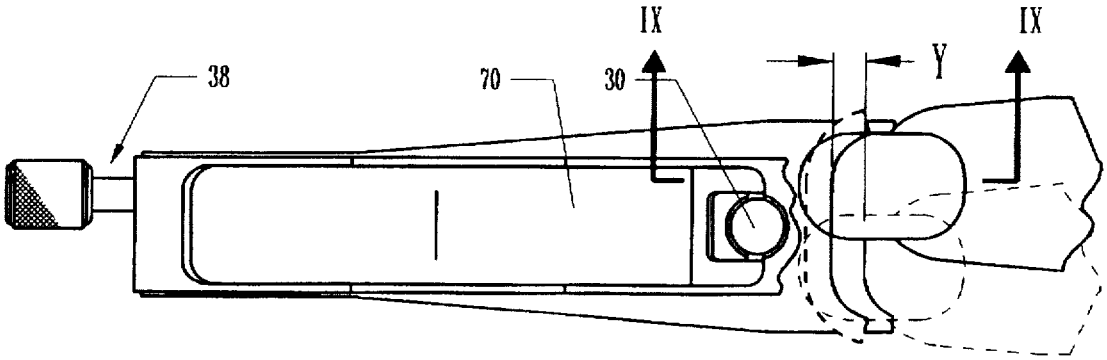
Figure 8:
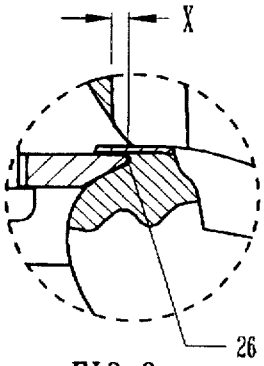
FIGS. 8 and 9 are enlarged side view sectional illustrations taken along respective lines VIII—VIII and IX—IX in FIGS. 6 and 7 respectively.
Figure 9:
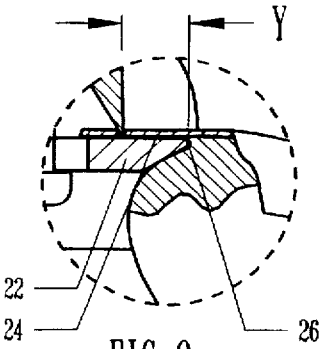
Figure 10:
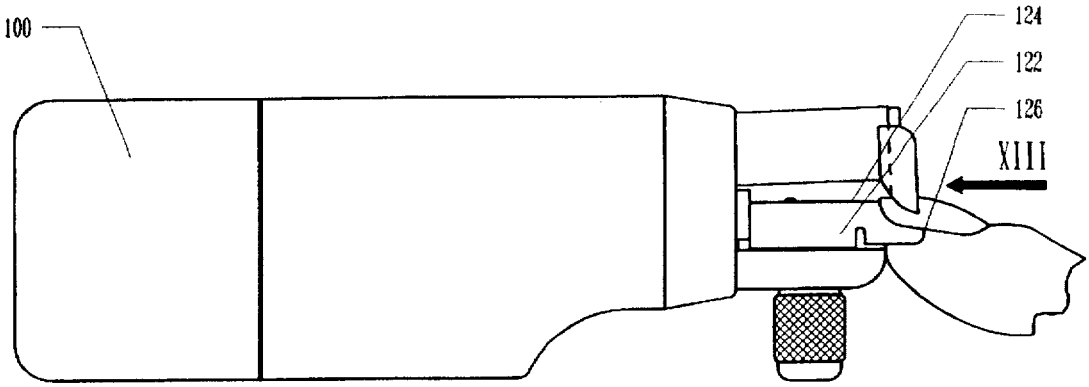
FIG. 10 is a side view illustration of a powered nail cutter constructed and operative in accordance with a preferred embodiment of the present invention.

A relatively close cut is produced when the edge 26 and the cutting blade are separated by X as seen in FIGS. 2 and 6, while a relatively long cut is produced when the edge 26 and the cutting blade are separated by Y in FIGS. 3 and 7.

It is an additional particular feature of the present invention that the width of the cutting blade 52 is greater than that of most nails to be cut and the cutting blade is formed with curves 62 and 64 at both edges thereof, such that a nail can be sequentially brought into cutting position adjacent both edges of the cutting blade for complete cutting of the nail. This is seen particularly in FIGS. 6 and 7.

The nail cutter of FIGS. 1–9 is formed with a conventional cutting lever 70 which is pivotably mounted in a slot 72 in pin 30. Cutting lever 70 is preferably stamped of alloy steel and is formed with a bent forward portion 73 defining a pivot axle 74 for pivotable engagement with slot 72 of pin 30 and an elongate rear portion 76 for manual engagement by a user.

An elbow 78 defined by the junction of the bent forward portion 73 and the elongate rear portion 76 engages the cutting element 50, for pushing the cutting blade against the cutting surface 24, as seen from a consideration of FIGS. 2 and 3. FIG. 1 shows the lever 70 in a flipped over locked position.

Reference is now made to FIGS. 10–15, which illustrate an electrically powered nail cutter constructed and operative in accordance with a preferred embodiment of the present invention. The nail cutter preferably comprises a housing 100, typically formed of plastic. Disposed within housing 100 there is preferably provided an electric motor 102 which is coupled to an eccentric drive 104 via a reduction gear assembly 105.

Eccentric drive 104 preferably produces forced rocking pivotal motion of a cutting assembly 106, which is pivotably mounted for rotation about an axis 108. Replaceably mounted onto a front surface of cutting assembly 106 there is preferably provided a cutting blade 110.

A base element 120 is preferably provided at the front of housing 110 and has selectably mounted thereon a cutting plate 122 at a forward portion thereof, having an upper facing cutting surface 124. The cutting plate 122 has a forward facing edge surface 126 which is intended to engage the forward facing surface of a finger under a nail to be cut. The cutting plate 122 may also be replaceable and may be selected to have a length corresponding to a desired depth of cut.

Rearward of edge surface 126, the cutting plate 122 preferably defines an aperture 128 which is engaged by a pin 130. Pin 130 is preferably eccentrically mounted onto a positioning knob 132, which is retained within base element 120 as by a spring mounted ball 134 which engages a suitable recess 136 formed in knob 132. Rotation of knob 132 by a user determines the depth of cut of a user's nail, by selecting the transverse distance between edge surface 126 and cutting blade 110.

It is a particular feature of the present invention that the cutting blade 110 is positioned to operatively engage a generally non-sharpened cutting plate surface 124, in contrast to the prior art wherein a pair of cutting blades are provided for blade-to-blade facing engagement.

It is a further particular feature of the present invention that the cutting blade 110, and preferably also the cutting plate surface 124, is curved in three dimensions so as to be adapted to the curvature of a user's nail to be cut. This curvature is shown particularly in FIG. 13.

It is an additional particular feature of the present invention that the position of the forward edge surface 126 is adjustable relative to the cutting blade 110 for determining the depth of the cut.

Figure 11:
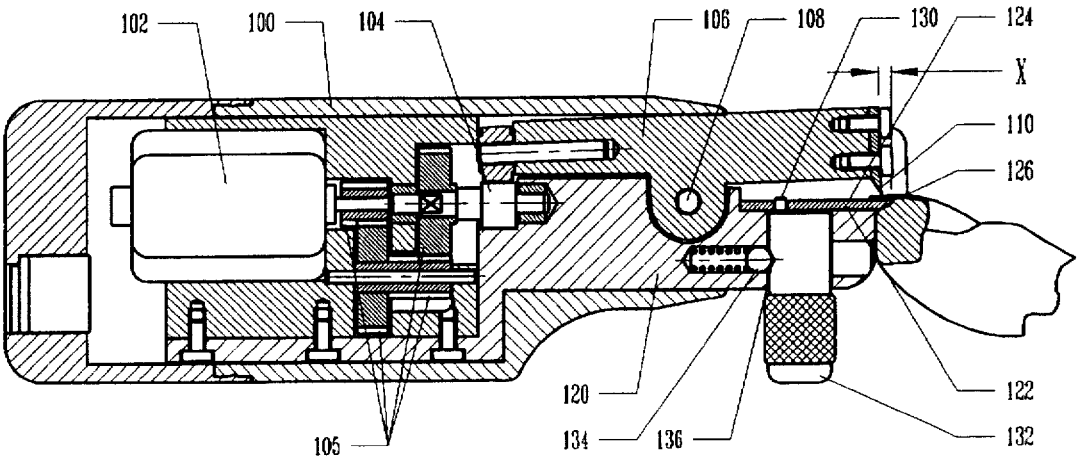
FIG. 11 is a side sectional illustration of the nail cutter of FIG. 10 in close-cut operative engagement with a nail about to be cut.
Figure 12:
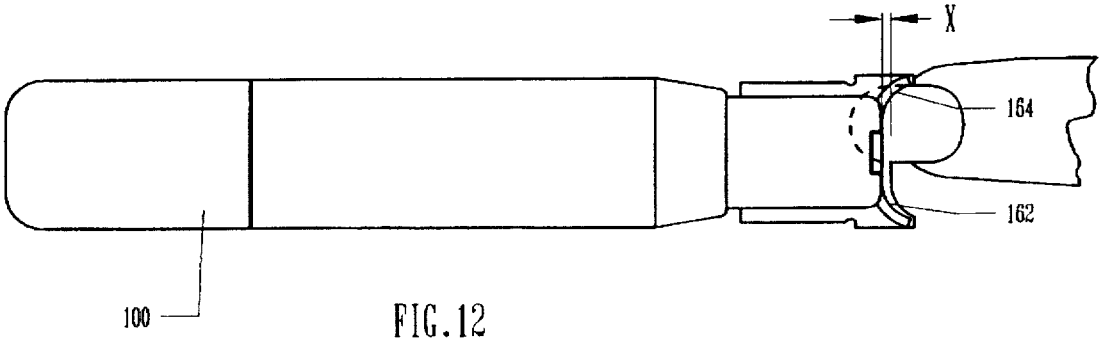
FIG. 12 is a top view illustration of the nail cutter of FIGS. 10 and 11 in close-cut operative engagement with a nail about to be cut.
Figure 13:
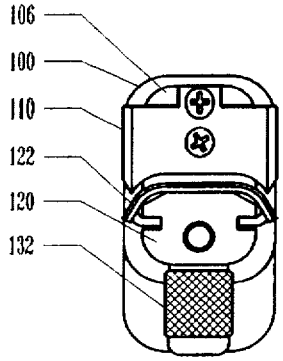
FIG. 13 is a front view illustration of the nail cutter of FIG. 10 taken along the arrow XIII in FIG. 10.
Figure 14:
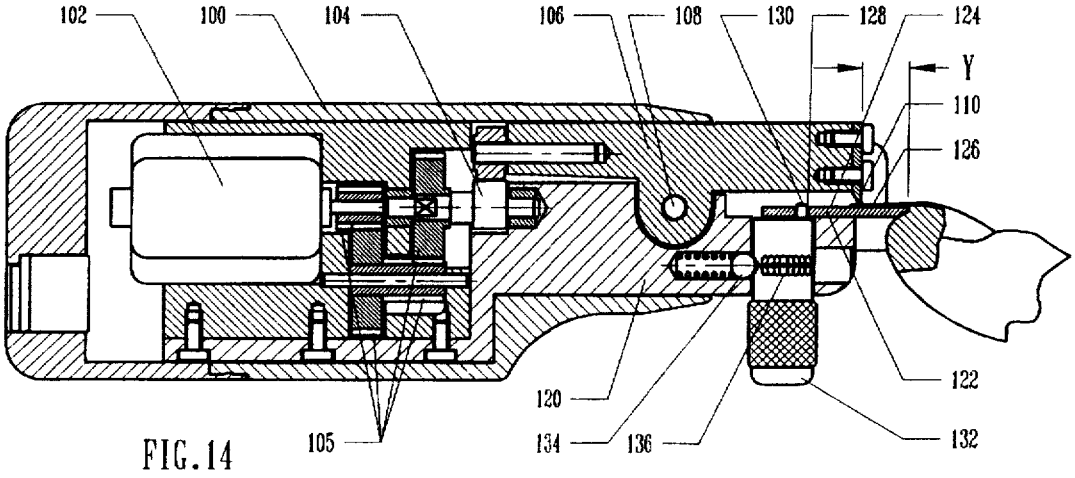
FIG. 14 is a side sectional illustration of the powered nail cutter of FIG. 10 in long-cut operative engagement with a nail about to be cut.
Figure 15:
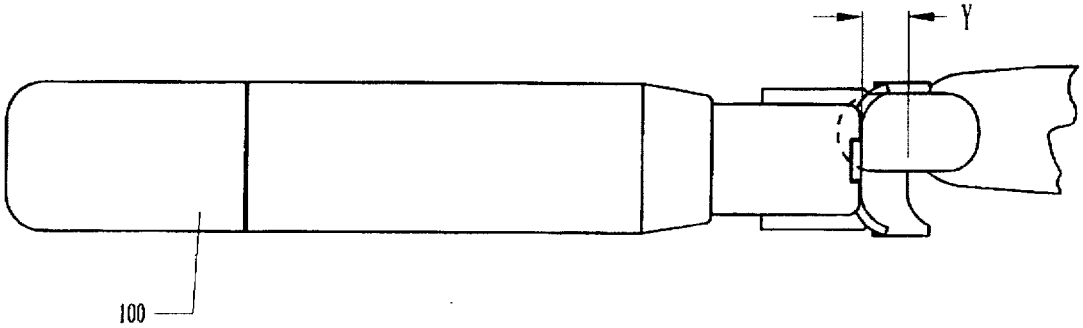
FIG. 15 is a top view illustration of the nail cutter of FIGS. 10 in long-cut operative engagement with a nail about to be cut.

A relatively close cut is indicated by X in FIGS. 11 and 12, while a relatively long cut is indicated by Y in FIGS. 14 and 15.

It is an additional particular feature of the present invention that the width of the cutting blade 110 is greater than that of most nails to be cut and the cutting blade is formed with curves 162 and 164 at both edges thereof, such that a nail can be sequentially brought into cutting position adjacent both edges of the cutting blade for complete cutting of the nail. This is seen particularly in FIGS. 12 and 15.

It will be appreciated by persons skilled in the art that the present invention is not limited to what has been particularly shown and described hereinabove. Rather the scope of the present invention includes combinations and subcombinations of the various elements described hereinabove as well as variations and further developments thereof which would naturally occur to persons skilled in the art upon reading the above description and which are not in the prior art.

I claim:

1. A nail cutter including a cutting plate defining a non-sharpened cutting surface, a cutting blade and a driver for bringing the cutting blade and the cutting surface into cutting engagement with a nail disposed between the cutting blade and the cutting surface, said cutting blade being curved in three separate orthogonal planes so as to be adapted to the curvature of a user's nail to be cut.

2. A nail cutter according to claim 1 and wherein said cutting plate is selectably positionable relative to said cutting blade and also comprising a cutting plate positioner operative to selectably position a forward surface of said cutting plate relative to the cutting blade for determining the depth of the cut.

3. A nail cutter according to claim 1 and wherein the cutting blade is formed with curves at both edges thereof, such that a nail can be sequentially brought into cutting position adjacent both edges of the cutting blade for complete cutting of the nail.

4. A nail cutter according to claim 2 and wherein the cutting blade is formed with curves at both edges thereof, such that a nail can be sequentially brought into cutting position adjacent both edges of the cutting blade for complete cutting of the nail.

5. A nail cutter including a cutting surface, a cutting blade and a driver for bringing the cutting blade and the cutting surface into cutting engagement with a nail disposed between the cutting blade and the cutting surface, wherein at least said cutting blade is curved in three separate orthogonal planes so as to be adapted to the curvature of a user's nail to be cut.

6. A nail cutter according to claim 5 and wherein said cutting plate is selectably positionable relative to said cutting blade and also comprising a cutting plate positioner operative to selectably position a forward surface of said cutting plate relative to the cutting blade for determining the depth of the cut.

7. A nail cutter according to claim 5 and wherein the cutting blade is formed with curves at both edges thereof, such that a nail can be sequentially brought into cutting position adjacent both edges of the cutting blade for complete cutting of the nail.

8. A nail cutter according to claim 6 and wherein the cutting blade is formed with curves at both edges thereof, such that a nail can be sequentially brought into cutting position adjacent both edges of the cutting blade for complete cutting of the nail.

9. A nail cutter including a cutting surface, a cutting blade and a driver for bringing the cutting blade and the cutting surface into cutting engagement with a nail disposed between the cutting blade and the cutting surface, wherein said cutting plate is selectably positionable relative to said cutting blade and also comprising a cutting plate positioner operative to selectably position a forward surface of said cutting plate relative to the cutting blade for determining the depth of the cut.

10. A nail cutter according to claim 9 and wherein the cutting blade is formed with curves at both edges thereof, such that a nail can be sequentially brought into cutting position adjacent both edges of the cutting blade for complete cutting of the nail.

11. A nail cutter according to claim 1 and wherein said driver is electrically powered.

12. A nail cutter according to claim 5 and wherein said driver is electrically powered.

13. A nail cutter according to claim 9 and wherein said driver is electrically powered.

14. A nail cutter according to claim 2 and wherein said forward surface is curved in three dimensions so as to be adapted to the curvature of a user's nail to be cut.

15. A nail cutter according to claim 2 and wherein said forward surface extends beyond said cutting blade.

16. A nail cutter according to claim 6 and wherein said forward surface is curved in three dimensions so as to be adapted to the curvature of a user's nail to be cut.

17. A nail cutter according to claim 6 and wherein said forward surface extends beyond said cutting blade.

18. A nail cutter according to claim 1 and wherein said cutting blade is replaceable.

* * * * *